United States Patent [19]

Roberts

[11] Patent Number: 4,731,890

[45] Date of Patent: Mar. 22, 1988

[54] PILLOW

[75] Inventor: Frank L. Roberts, Willowdale, Canada

[73] Assignee: Bio-Support Industries Ltd., Toronto, Canada

[21] Appl. No.: 944,585

[22] Filed: Dec. 22, 1986

[51] Int. Cl.[4] ..... A47G 9/00

[52] U.S. Cl. ..... 5/431; 5/434; 5/436

[58] Field of Search ..... 5/434, 436, 437, 441, 5/464, 442, 431; D6/601; 269/328

[56] References Cited

U.S. PATENT DOCUMENTS

| | | | |
|---|---|---|---|
| 1,787,832 | 1/1931 | Mueller | 5/436 |
| 2,149,140 | 2/1939 | Gonzales-Rincones | 5/436 |
| 2,336,707 | 12/1943 | Thompson | 5/436 |
| 4,060,863 | 12/1977 | Craig | 5/437 |
| 4,173,048 | 11/1979 | Varaney | 5/442 |
| 4,197,604 | 4/1980 | Nakamura | 5/437 |
| 4,345,347 | 8/1982 | Kantor | 5/436 |
| 4,574,412 | 3/1986 | Smith | 5/436 |

FOREIGN PATENT DOCUMENTS

| | | | |
|---|---|---|---|
| 222827 | 1/1925 | United Kingdom | 5/441 |
| 838455 | 6/1960 | United Kingdom | 297/393 |

*Primary Examiner*—Alexander Grosz
*Attorney, Agent, or Firm*—Kenneth M. Garrett

[57] ABSTRACT

A pillow adapted for use by nursing mothers comprises a pair of arms forming an L shape. One of the arms is wider than the other, and preferably is less densely filled, so as to form an infant support surface, the other arm functioning as a cushion support for the mother. The free end of the arms may be secured in proximity whereby the pillow assumes a generally rectangular shape, for use as a normal bed pillow.

4 Claims, 5 Drawing Figures

PILLOW

FIELD OF INVENTION

The invention relates to a pillow. It particularly relates to a pillow configured for use by nursing mothers, although it is not necessarily limited to such use.

BACKGROUND OF INVENTION

The traditional shape of a pillow for supporting the head of a person when sleeping in bed, or the trunk of the person when sitting is a more or less erect position, is that of a rectangular prism. The body such pillow is stuffed with a resilient stuffing for example feathers or kapok, or more latterly and preferably with a manufactured material, for example foamed sythetic rubber, or polyester fibers. Generally such pillow is proportioned for use with a particular size of bed, but in most instances is of limited lateral extent such that it does not exert a cradling action on the trunk of a person when used with the body in a seated position, nor does it provide support for the arms of a person in this position.

When nursing an infant with the mother in a seated position, the weight of the infant is normally supported by the cradling arm of the mother. It is of course possible to use a traditional pillow to support the infant, and another pillow to support the back of the mother. However, it is desirable to provide a continuous support surface wherein the various portions are anchored the one by the other so as to hold each relative to the other. It is also desirable to provide in such pillow, a pillow that can be used for its normal purpose of supporting the head during sleep, and or supporting the body or portions thereof in other attitudes.

SUMMARY OF THE INVENTION

The present invention seeks to provide in a pillow having a structure to meet the needs of a nursing mother.

In accordance with a broad aspect of the invention, a pillow comprises an L shaped body including a hollow, flexible sheath and a resilient stuffing material packed within the sheath. One arm of the body is proportioned so as to have an aspect ration, as that term is more particularly defined hereinafter, of about 1, while the other arm is proportioned to have an aspect ration of about 2, while the ratio of the length of the one arm to the other arm is about 3:4.

The arm with the lower aspect ration will present a relatively broad surface upon which an infant can be supported while being nursed, or at other times. The arm with the higher aspect ratio will normally form a cushion for the back of the nursing mother, and will act to anchor the infant support surface in place, in horizontal planes.

Preferably, the stuffing material will be packed in the one arm at a somewhat lower density than that of the stuffing in the other arm. Accordingly, the one arm may be relatively soft, so as to permit the weight of the infant to inwardly deform the upper surface of the pillow to form a minor concavity when the infant is placed thereon, whereby the infant will not tend to roll off of the surface even when not cradled. The other arm may be sufficiently hard so as to withstand the heavier pressure exerted thereon.

In accordance with a preferred embodiment, means is provided for securing the inwardly facing flanks of the pillow in proximity, whereby the pillow assumes the approximate shape of a normal rectangular prismatic pillow, and can be used for sleeping purposes. Put another way, the pillow of the invention does not have to be interchanged with a normal bed pillow for sleeping purposes. The provision of arms with different density stuffings permits the nursing pillow, when used for sleeping purposes, to be used by a person with a preference for a softer pillow for cradling the head, or alternatively by a person with a preference for a harder pillow.

These aims and advantages of the invention, and other features thereof will become more apparent from the following description of a preferred embodiment thereof, reference being made to the accompanying drawings.

DESCRIPTION OF THE PREFERRED EMBODIMENT

Figure 1:
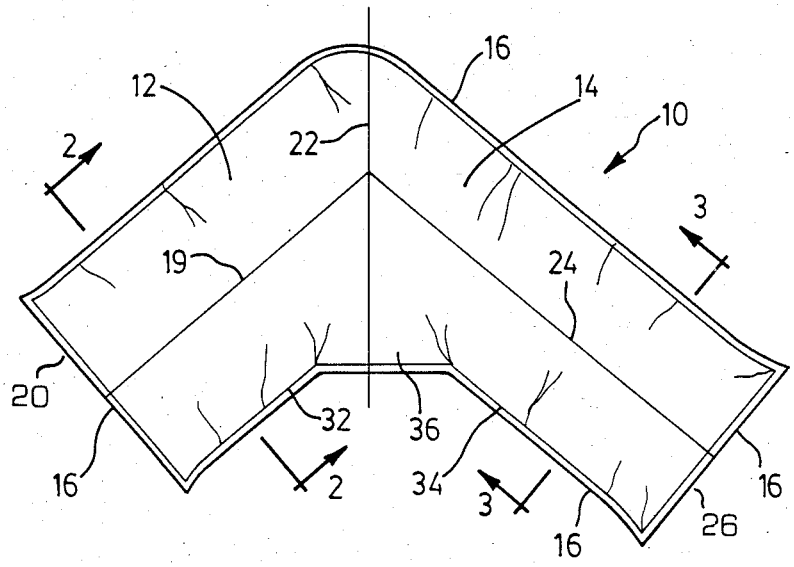
FIG. 1 is a plan view of the pillow.
Figure 2:
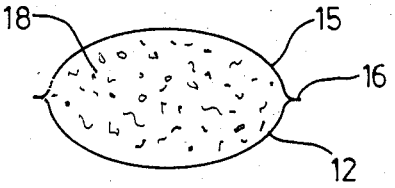
FIG. 2 is a cross section of 2—2 of FIG. 1.
Figure 3:
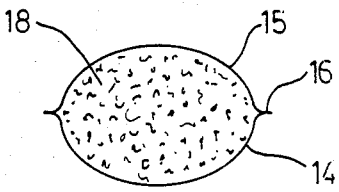
FIG. 3 is a cross section of 3—3 of FIG. 1.

Considering now the drawing in detail, a pillow constructed in accordance with the invention is represented generally therein by the numeral 10.

Pillow 10 is an L shaped body comprising a pair of divergent arms 12,14. Arms 12,14 are tubular, and are conveniently made from a pair of identical, L shaped pieces of woven cloth material 15 hemmed together around their periphery at 16.

Pillow 10 is stuffed with a polyester staple fiber 18, for example such as is sold in commerce under the trademarks Qualofil and Fibrefill. Stuffing of this nature is conveniently blown into arms 12,14 from the end of one arm prior to that end being hemmed closed. The density of packing of staple fibre 18 is somewhat greater in arm 14 than in arm 12.

Arm 12 has a length of L1 and a width W1, and arm 14 has a length of L2 and a width W2. The length of arm 12 is measured on notional line 19 which extends at mid width of the arm between the distal end 20 of arm 12 to the notional angular bisector 22 between arms 12 and 14. The length L2 is similarly taken on notional line 24 which extends at mid width of arm 14 between the distal end 26 thereof and angular bisector 22. The aspect ratio of an arm is the ratio of the length of the arm, as above defined, to the width thereof. Arm 12 has an aspect ratio of about 1, whereas arm 14 has an aspect ratio of about 2.

The ratio L1:L2 of the lengths of the arms 12 and 14 respectively is about 3:4. The actual dimensions and ratios are not critical, and may vary from those above. However, the dimensions will be selected with the aim of arm 12 providing a major surface for adequately supporting an infant thereon, in both the lateral and longitudinal directions, while arm 14 is positioned behind the back of a seated person, in which position the pillow should adequately support the back of the person. When pillow 10 is dimensioned such that the above ratios and conditions prevail, it is found that when the arms 12, 14 of the pillow are collapsed inwardly towards the position illustrated in FIG. 5, the distal ends 20,26 of the pillow are in close proximity, without the proximal ends thereof developing any undue rucks, ridges or puckers. Consequently pillow 10 when in the collapsed position of FIG. 5 is relatively compact and serves well as a normal bed pillow for a supine person, with the added advantage that the pillow may be suited for use equally by persons having a preference for a hard pillow and those having preference for a softer pillow.

The inwardly facing flanks 32,34 of arms 12,14 at their proximal ends are inwardly turned to form a gusset 36, which acts as a filler when the arms 12, 14 are collapsed. Also, the gusset 36 provides for extra padding and support when the pillow is used with the crotch thereof behind the back of a user, with arms 12, 14 projecting on each lateral side thereof.

Figure 5:
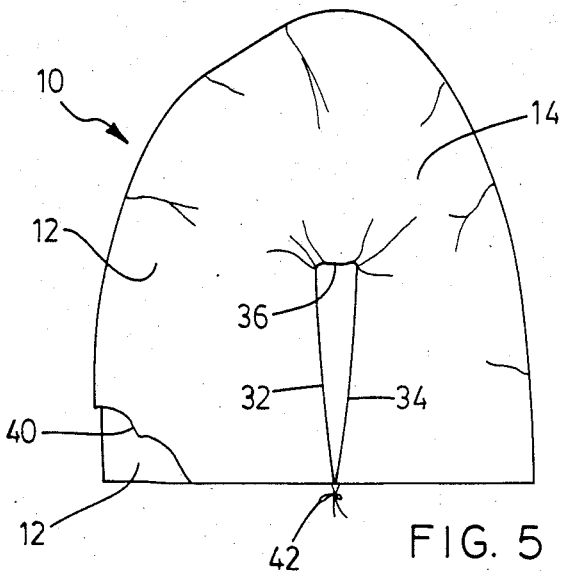
FIG. 5 is a plan view of the pillow with a covering case therefor and with the arms of the pillow secured in proximity, partially broken away to reveal the interior.

Pillow 10 will normally be used in conjunction with a pillow case 40 which is provided with ties 42 secured adjacent the distal ends of the inwardly facing flanks thereof, whereby pillow 10 may be retained in its collapsed position illustrated in FIG. 5. The ties 42 may equally be secured directly to cover material 15 of pillow 10, and access openings provided in pillow case 40.

Pillow 10 will be used by a mother while nursing an infant when the pillow is in its extended, non-collapsed position, as illustrated in FIG. 1. In such use arm 14 will normally locate behind the back of the mother, whereby arm 12 will project forwardly on one lateral side to form a infant support surface.

Figure 4:
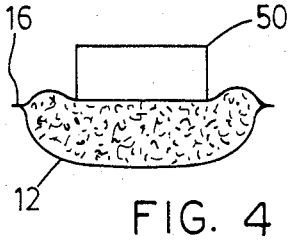
FIG. 4 is a cross section taken at 2—2, but with a mass applied thereto.

The density of packing of the staple fiber 18 in arm 14 will be such as to provide reasonable support for the back of the mother. The density of packing in arm 12 will be such that the upper surface of arm 12 forms a small concavity when the weight of an infant is supported thereon, whereby the infant will be unlikely to roll off of the surface. A simple test for suitable density of packing of arm 12 is indicated schematically in FIG. 4, where a mass 50 exerting a pressure of about .05 psi is supported on the arm.

The invention will be understood from the foregoing description thereof. It will be apparent that many modifications from the preferred, illustrative embodiment may be made without departing from the spirit of the invention and it is intended that all such departures fall within the scope of the claims appended hereto.

I claim:

1. A pillow adapted to be used in nursing an infant by a seated adult, with an arm of the pillow sized to support a nursing infant, and the other arm of the pillow adapted to support the back of a seated adult, the pillow comprising a hollow flexible L shaped sheath including first and second arms, the first said arm having an aspect ratio of about twice that of the second said arm; and a stuffing material packed within said sheath, the packing density of said stuffing in said first arm being greater than that in said second arm, wherein the length of said arms is such that as said arms are inwardly collapsed, opposed inwardly facing flank portions adjacent each distal end thereof are generally contiguous, wherein the ratio of the length of said first arm to second arm is in the ratio of about 4:3, the pillow including means for securing the inwardly facing flanks of said arms in close proximity, whereby when the arms are secured in close proximity, the pillow is adapted for conventional uses, and provides a softer and a harder portion.

2. A pillow as defined in claim 1, wherein proximal, inwardly facing flanks thereof are inwardly turned to form a gusset.

3. A pillow as defined in claim 1, further including a cover therefor, and wherein said means for securing said arms in closed proximity is provided on said cover.

4. A pillow as defined in claim 1, wherein said resilient stuffing material is a polyester filament.

* * * * *